US005637248A

United States Patent [19]

Park

[11] Patent Number: 5,637,248

[45] Date of Patent: Jun. 10, 1997

[54] METHOD AND DEVICE FOR PREVENTING OVERHEATING OF INVERTER COOKER

[75] Inventor: Joung I. Park, Seoul, Rep. of Korea

[73] Assignee: Goldstar Co., Ltd., Seoul, Rep. of Korea

[21] Appl. No.: 307,210

[22] Filed: Sep. 16, 1994

[30] Foreign Application Priority Data

Sep. 17, 1993 [KR] Rep. of Korea ..... 1993-19024

[51] Int. Cl.[6] ..... H05B 1/02

[52] U.S. Cl. ..... 219/492; 219/508; 219/497; 99/328; 99/333

[58] Field of Search ..... 219/492, 493, 219/497, 508, 509, 505, 719; 99/325, 328, 329, 331, 333

[56] References Cited

U.S. PATENT DOCUMENTS

| | | | |
|---|---|---|---|
| 4,438,324 | 3/1984 | Narita et al. | 219/441 |
| 4,687,910 | 8/1987 | Aoshima et al. | 219/506 |
| 4,962,299 | 10/1990 | Duborper et al. | 219/492 |
| 5,111,026 | 5/1992 | Ma | 219/492 |
| 5,155,339 | 10/1992 | An | 219/492 |
| 5,398,597 | 3/1995 | Jones et al. | 99/330 |
| 5,408,073 | 4/1995 | Jeong | 219/623 |

*Primary Examiner*—Mark H. Paschall
*Attorney, Agent, or Firm*—Spencer & Frank

[57] ABSTRACT

A method and device for preventing a danger of fire outbreak generated by a needless material inserted between metal fan and bottom sensor comprising means for means for comparing a voltage equivalent to a detecting temperature of bottom sensor with a reference voltage equivalent to a designated cooking temperature, generating signals equivalent to ending of cooking function or not ending from a resultant value counting cooking function time according to system clock and controlling heat source voltage from a resultant value which performs AND-gate operation with the signal outputted from the generating means and the signal outputted from the comparing means and performs cooking by method for controlling cooking process judging the insertion of a needless materials from counting values of driving cooking process counter in case that detecting temperature of a metal pan is lower than the temperature designated for cooking.

3 Claims, 6 Drawing Sheets

METHOD AND DEVICE FOR PREVENTING OVERHEATING OF INVERTER COOKER

FIELD OF THE INVENTION

This invention relates to inverter cooker, more particularly to inverter cooker for preventing a danger of fire outbreak generated by a needless material inserted between metal fan and bottom sensor.

BACKGROUND OF THE INVENTION

Generally, a cooking process has a step for soaking rice in water, a step for boiling rice, a steam—settle—down step and keeping-warm step.

Hereinafter, the step for soaking rice in water is designated by a soaking step and the step for boiling rice is designated by boiling step.

Referring to FIG. 1, this is a circuit diagram of conventional inverter cooker. The said inverter cooker comprises bottom sensor 1 positioned to the beneath of metal pan and for detecting a temperature of a metal pan which serve meal like as rice in it, comparator 2 for comparing the voltage equal to the temperature detected by said bottom sensor 1 with the reference voltage, 1st and 2nd counter 3, 4 for controlling the soaking step and a steam-settle-down step, switching part 5 which is switched according to the signal controlling cooking process, AND gate 6 which operates the signal equivalent to the switching state of the said switch part 5 with the output of the said comparator by logic product and power supply part 7 which supply a certain serial power of B+.

The said power supply part 7 includes switching element Q1 which is switched according to the output of the said AND-gate 6 and photocoupler 7*a* for converting a photo signal generated by switching of the said switching element Q1 to electric signal, wherein the photocoupler consist is of photodiode and phototransistor.

The detail descriptions about this conventional art are given as follows using the circuit diagram of FIG. 1.

When a cooking start key is pressed by user after power supply, system controller(not shown to the drawing) takes the soaking step. The step makes the 1st counter 3 enable and 1st switch awl a connecting state(ON state), 2nd switch SW2 a open state(OFF state). Accordingly, the said 1st counter 3 counts a system clock inputted in it.

When the soaking step starts, the bottom sensor 1 positioned to the beneath of the metal pan detects the temperature of the said metal pan. The temperature detection of the said bottom sensor 1 utilizes a characteristic which a output voltage is varied with a change in a inner resistance value due to a temperature change of the metal pan.

The output voltage from the said bottom sensor 1 is inputted to a negative terminal(−), so that it is compared with the reference voltage which is inputted to a positive terminal(+).

From the above comparation, when the voltage inputted to the negative terminal(−) is lower than the reference voltage inputted to the positive terminal(+), the output of the said comparator 2 comes to have a high level, so that it is inputted to one side input terminal of AND-gate 6 connected with its latter terminal.

In this time, because a high potential is inputted to other side input terminal of the said AND-gate 6 according to ON state of the said 1st switch SW1, the output of the AND-gate 6 is high level.

The high signal outputted from the above AND-gate 6 turns the switching element Q1 on. By means of turning the said switching element Q1 on, the serial power of +B1 is applied to the photodiode(PD) in photocoupler 7*a*, so that the said photodiode(PD) comes to be a state of luminescence.

The phototransistor(PT) is turned on by photo signal generated according to luminescence of the said photodiode (PD).

Accordingly, the serial electric power is applied to inverter driving part which is connected to the latter terminal, so that the inverter cooker executes the soaking step continuously. The reference voltage Vref is varied with a execution of the soaking step. For instance, the said soaking step designates its equivalent reference voltage on the basis of 58° C. and the step for boiling rice on the basis of 120° C.

During execution of the above step, if counting of the 1st counter 3 is ended, the said soaking step is ended, too. At this time, the system controller part(not shown to the drawing) makes the 1st switch SW1 in the switching part 5 turned off and the 2nd switch SW2 turned on, to execute a sequential step for boiling rice.

In addition, the said system controller part designates the reference voltage of comparator 2 as a voltage equivalent to cooking step temperature of 120° C., and executes the above steps repeatedly, so that executes step for boiling rice.

When the boiling step is ended, it executes steam-settle-down step continuously.

The steam-settle-down step is executed by counting a time during a constant time according to the system clock like soaking step above mentioned, and as the steam-settle-down step is ended, a cooking process is ended.

Referring to FIG. 3, this is showing the state which a metal pan and bottom sensor is equipped. In case of being equipped normally like FIG. 3(A), the bottom sensor 1 can accurately detects the temperature of the bottom sensor, but in case that a needless material like rice etc. is inserted between the said metal pan A and the said bottom sensor 1, the detection temperature of the said bottom sensor is lowered relatively than that of case equipped normally like FIG. 3(B), so that it can't accurately detect the temperature of the metal pan. As cooking time is delayed pretty by means of above reason, the metal pan emits heat and surrounding temperature of the metal pan is elevated, so that there is a problem which a fire can occur.

SUMMARY OF THE INVENTION

It is an object of the present invention is to provide a method and device for preventing a danger of fire outbreak generated by a needless material inserted between metal pan and bottom sensor.

This object can be achieved by a method for preventing overheating of inverter cooker comprising steps for executing a soaking function for designated time after driving of counter of the soaking function as start key is inputted on initialized state, executing a cooking function after driving of cooking function counter in case that a detecting temperature of a metal is lower than the temperature designated for cooking, if the said soaking function is ended and executing a steam-settle-down function for designated time after driving of counter of the steam-settle-down function, if the steam-settle-down function is ended.

Other objects can be achieved by a device for preventing overheating of inverter cooker comprising means for comparing a voltage equivalent to a detecting temperature of bottom sensor with a reference voltage equivalent to a designated cooking temperature, means for generating signals equivalent to ending of cooking function or not ending from a resultant value counting cooking function time according to system clock and means for controlling heat source voltage from a resultant value which execute AND-gate operation with the signal outputted from the said generating means and the signal outputted from the said comparing means.

DETAILED DESCRIPTION OF THE INVENTION

Figure 1:
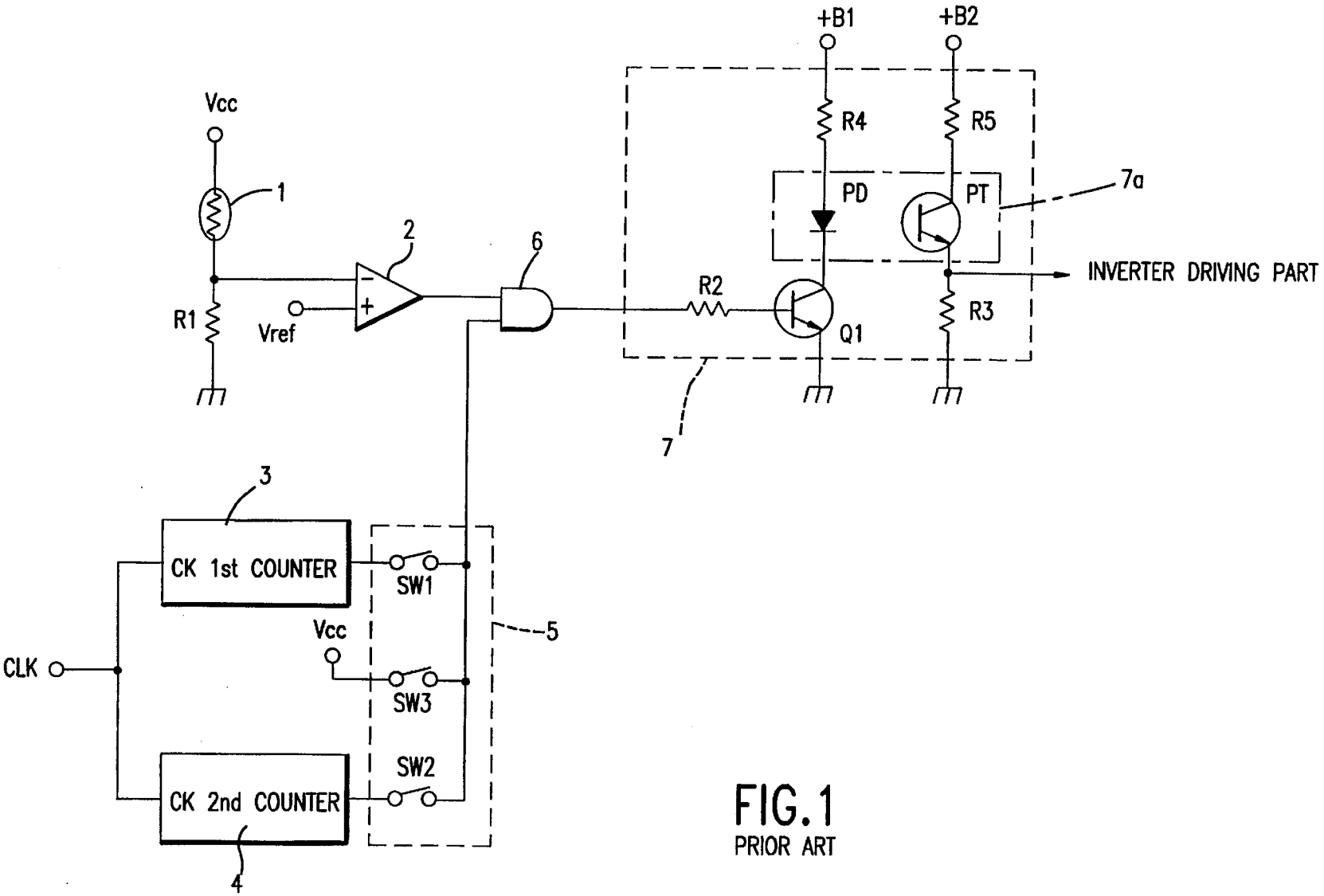
FIG. 1 PRIOR ART
FIG. 1 is a block diagram of conventional inverter cooker
Figure 2:
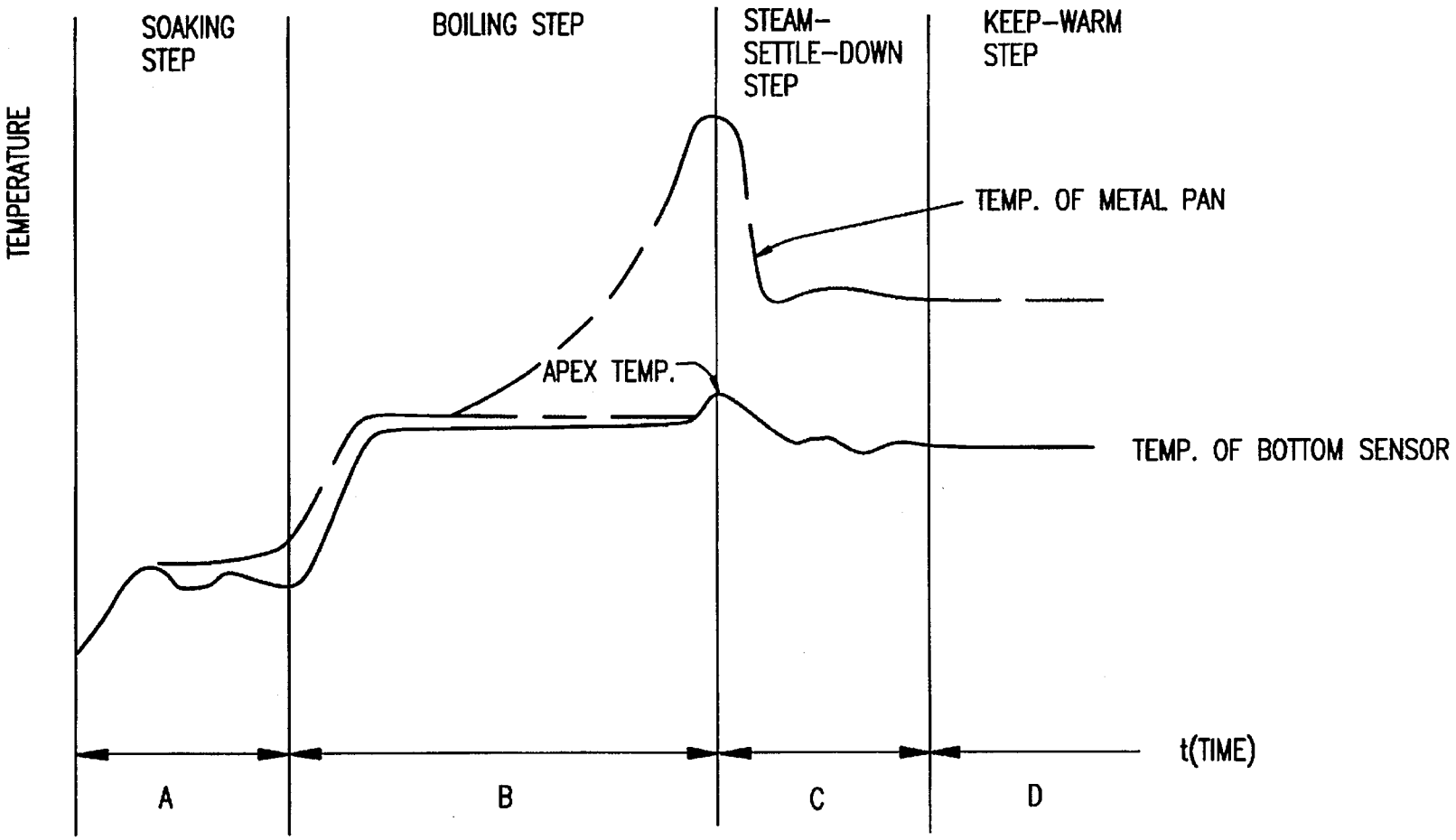
FIG.2 PRIOR ART
FIG. 2 is a conventional cooking process diagram in case that a needless material is inserted between metal pan and bottom sensor
Figure 3B:
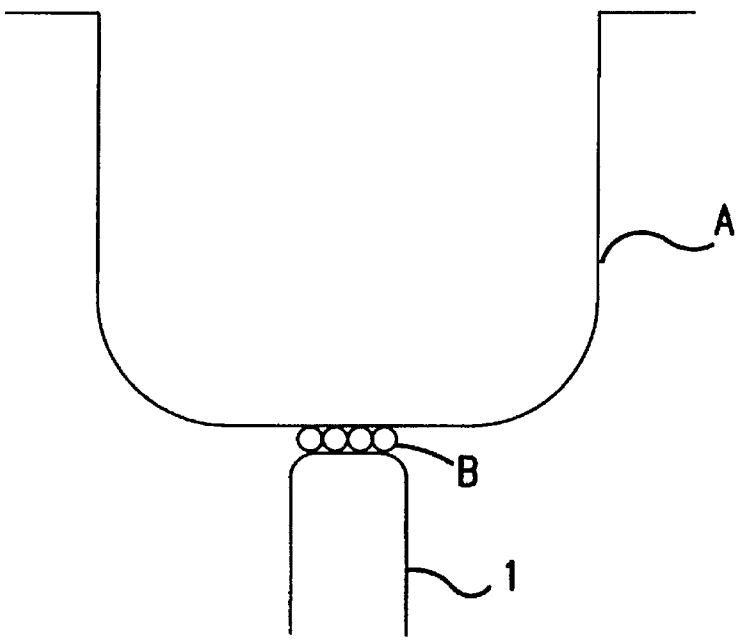
FIG.3B PRIOR ART
FIG. 3 is a section view showing a position relationship between metal pan and bottom sensor, (A) is a section view in case of a normal state (B) is a section view in case of a abnormal state that a needless as like rice is inserted.
Figure 3A:
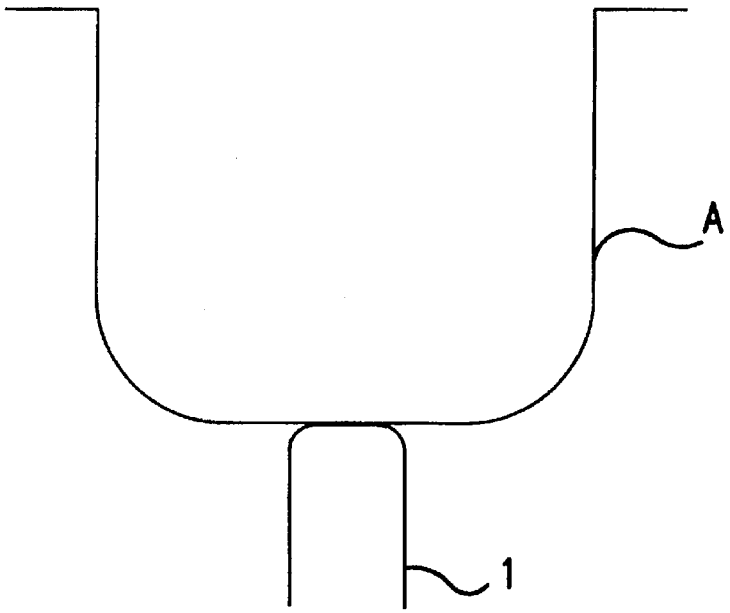
FIG.3A PRIOR ART
Figure 4:
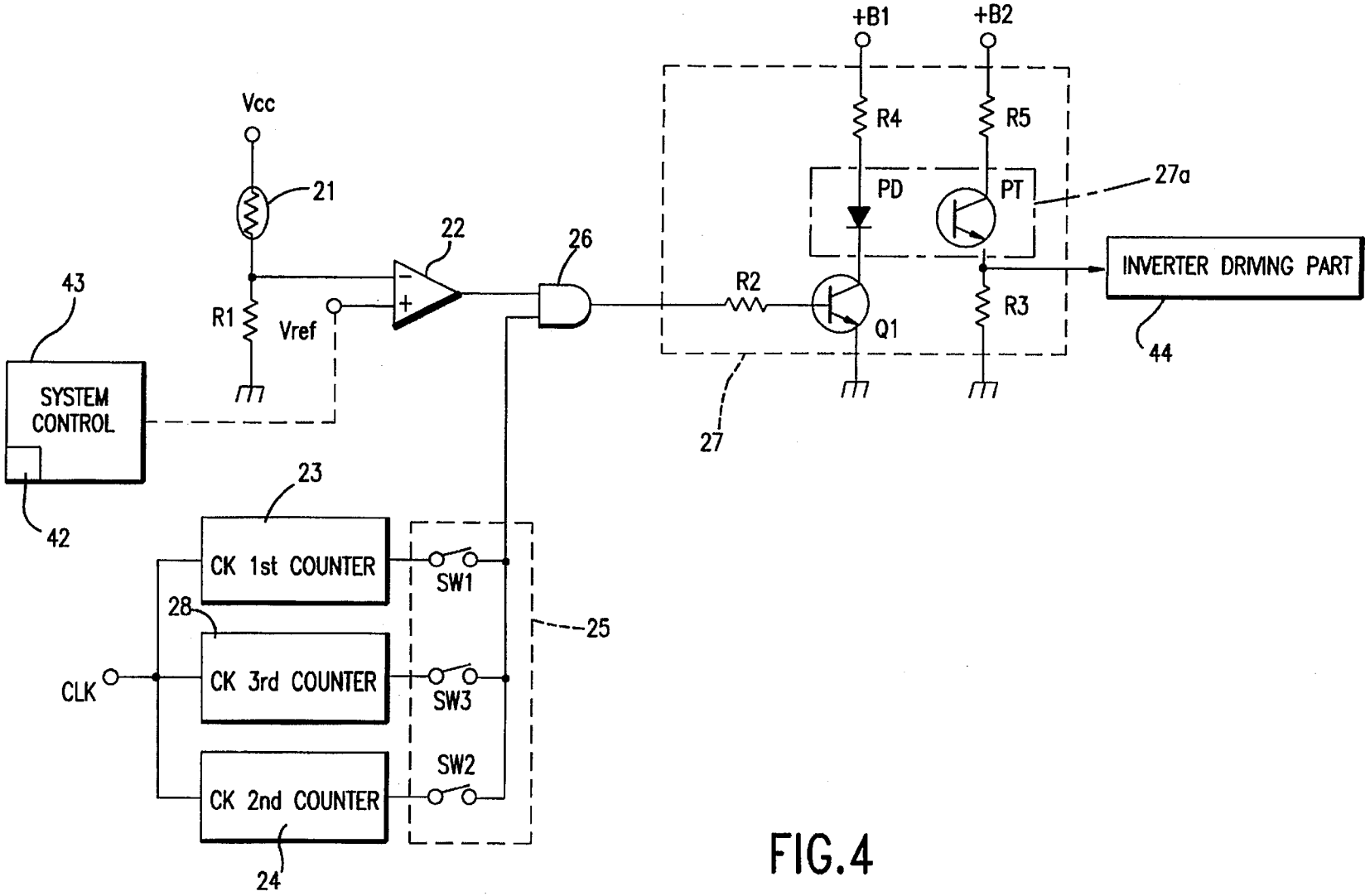
FIG. 4 is a circuit diagram showing a device for preventing overheating in accordance with the present invention.

Referring to FIG. 4, this is a circuit diagram showing a device overheating in accordance with the present invention.

This device comprises a bottom sensor 21 for detecting a temperature of it positioned to the beneath of metal pan, comparator 22 for comparing the voltage equivalent to the temperature detected by the said bottom sensor 21 with a reference voltage, 1st, 2nd and 3rd counter 23,24 and 28 for controlling the soaking step, the boiling step, the steam-settle-down step, switching part which is switched according to the output of the said counter 23, 24 and 28, AND-gate for performing AND-gating of a signal equivalent to a switching state of the said switching part 25 and a output signal of the said comparator 22 and power supply part 27 which supplies a electric power of heat source as switched according to output of the said AND-gate.

Figure 5:
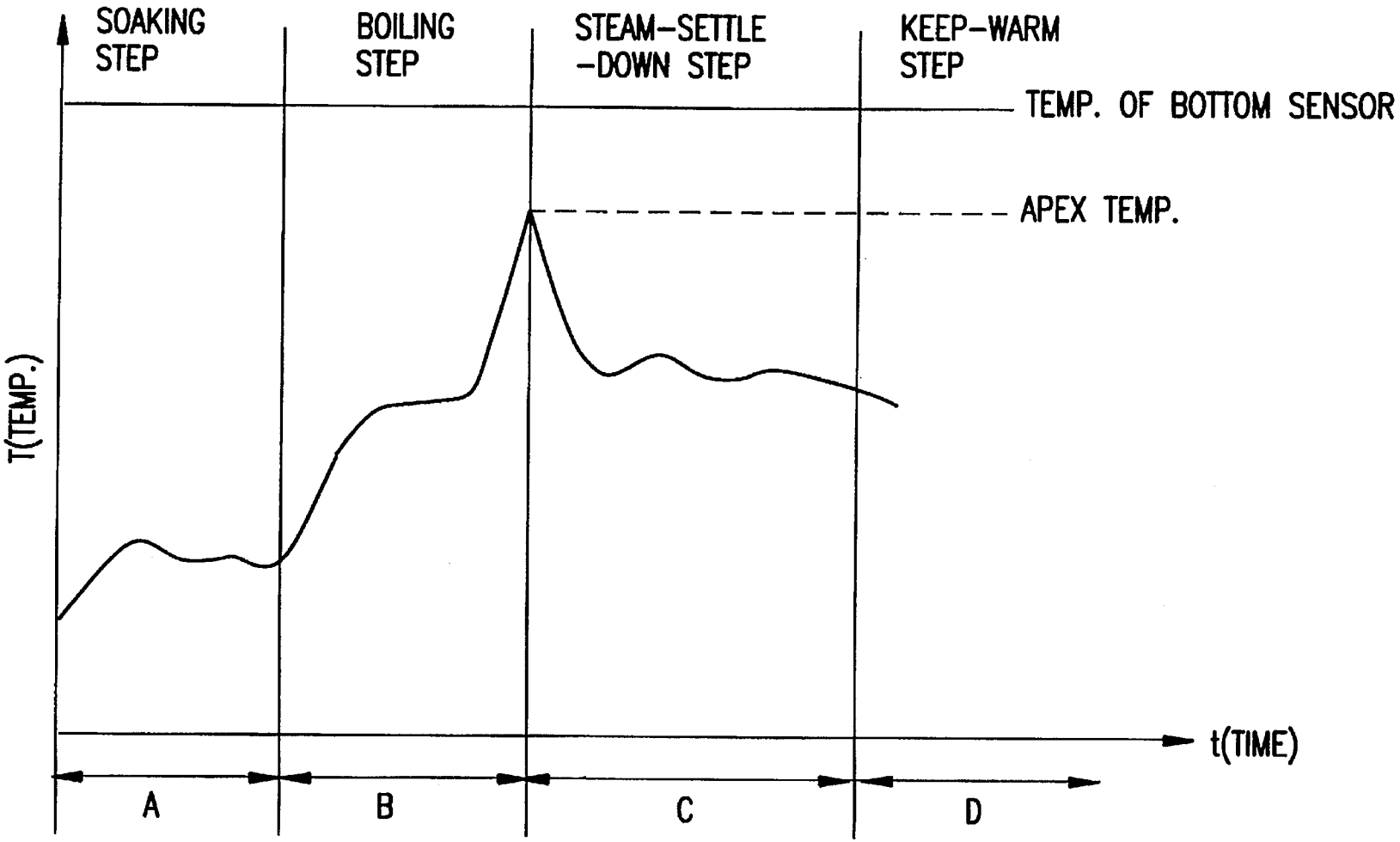
FIG. 5 is a cooking process diagram in accordance with the present invention.
Figure 6:
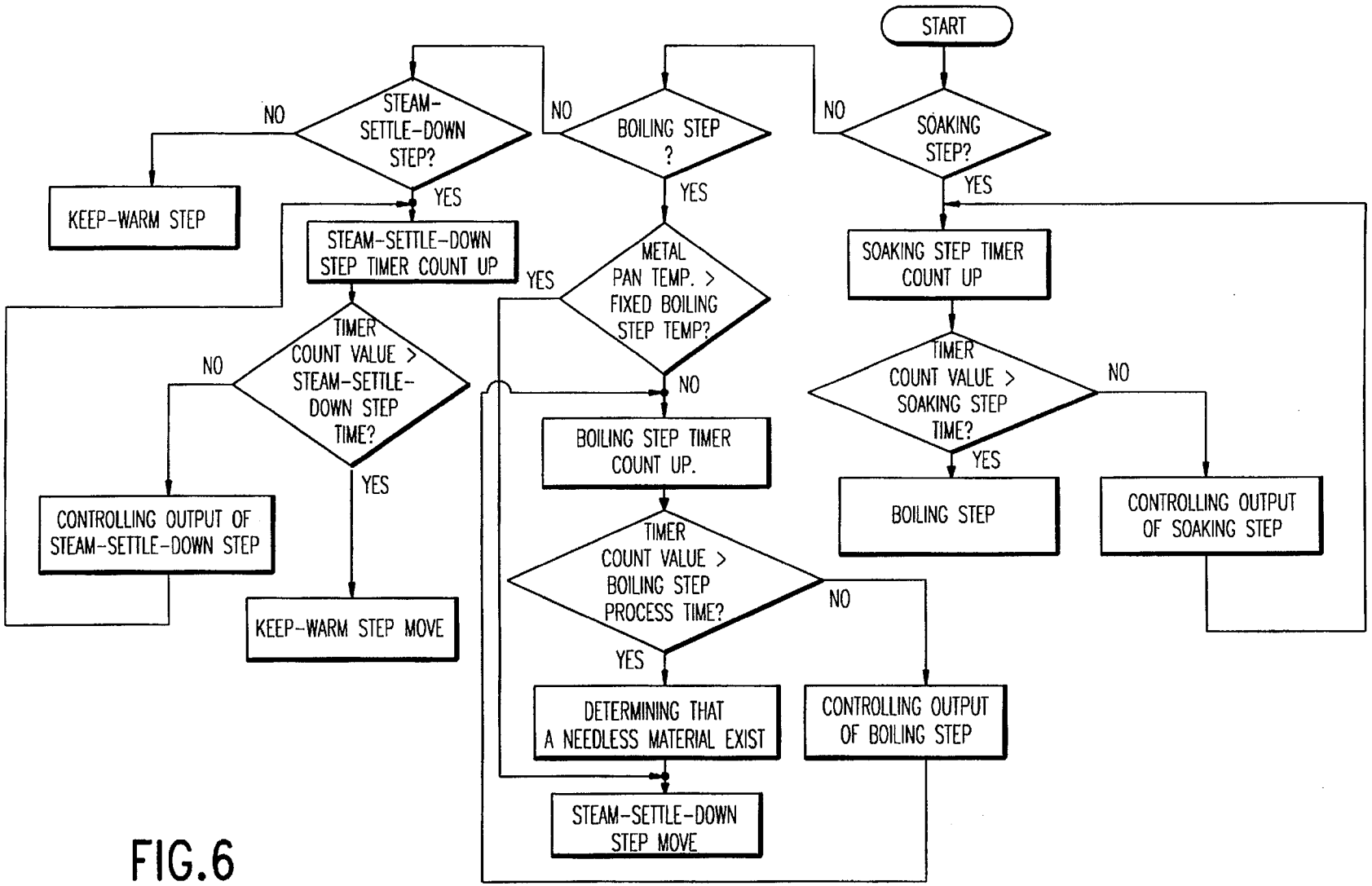
FIG. 6 is a flow chart showing a method for preventing overheating in accordance with the present invention.

This invention described as the above is going to be explained in detail with referring to the FIG. 5 and FIG. 6.

Firstly, when the cooking start key is pressed after the power is supplied, the system controlling part(not shown to the drawings) performs soaking step. That is, the said system controlling part 25 makes a soaking step counter of 1st counter enable state and makes 1st switch in switching part 25 on state. Additionally, it fixes reference voltage as voltage equivalent to the reference temperature (for example 58° C.) in soaking step.

As the soaking step starts, the bottom sensor positioned to the beneath of metal pan detects the temperature of metal pan.

Temperature change of the said metal pan according to lapse of time causes a change in inner resistance value of the said bottom sensor, so that changed voltage values equivalent to detection temperatures are outputted.

The voltage outputted from the said bottom sensor 21 is inputted to a negative terminal(−) of comparator 22, so that it is compared with the reference voltage(Vref) equivalent to soaking step.

When the voltage equivalent to the detecting temperature of the bottom sensor 21 is lower than the reference voltage, comparator 22 outputs a high level signal, and outputted signal is inputted to one side input terminal of AND-gate 26 connected with its latter portion.

In this time, because a high level signal is inputted to other side input terminal of the said AND-gate 26, the output of the AND-gate 26 is a high level. The high signal outputted from the above AND-gate 26 turns the switching element Q1 on. By means of turning the switching element Q1 on, the serial power of +B1 is applied to the photodiode(PD) in photocoupler 27*a*, so that the photodiode(PD) comes to be a state of luminescence.

The phototransistor(PT) is turned on by photo signal generated according to luminescence of the said photodiode (PD). Accordingly, the serial electric power is applied to inverter driving part which is connected to the latter terminal, so that the inverter cooker executes soaking step continuously.

During execution of the above function, if counting of the first counter 23 is ended, the soaking step is ended, too. At this time, the system controller part makes the 3rd counter 28 of cooking step counter enable and makes the 3rd switch SW3 turned on after turning 1st switch SW1 off, to execute the sequential cooking step.

The system controller makes progress the boiling step with a same method as the soaking step except for the case that makes the 3rd switch off, if counting of the 3rd counter is ended. At this time, 1st and 2nd switch are off-states.

AND-gate outputs a low signal irrelevant to output of the comparator 22 and controls power supply part 27 connected with its latter terminal. Accordingly, it ends boiling step, though a cooking temperature does not reach at the apex temperature of 120° C. as shown to FIG. 5

After the completion of the boiling step, the system controller makes 2nd counter 24 of steam-settle-down step counter enable to perform a sequential steam-settle-down step and makes 2nd switch on. After this, if counting of the 2nd counter 24 is ended for fixed time, it ends the said steam-settle-down step and perform keeping-warm step.

Referring to FIG. 5, this is showing cooking process diagram in accordance with the present invention. A width axis expresses time and a length axis temperature.

As apparent from the above description, the present invention provides a prevention device for beforehand preventing an outbreak of fire capable of occurring because of the delay of cooking time due to a needless materials inserted between bottom sensor and metal pan.

Although the preferred embodiments of the invention have been disclosed for illustrative purpose, those skilled in the substitutions are possible, without departing from the scope and spirit of the invention as disclosed in the accompanying.

What is claimed is:

1. A method for preventing overheating of an inverter cooker having a metal pan and soaking, cooking and steam-settle-down functions, said method comprising the steps of:

(a) starting a first counter and applying heat to said cooker at a first temperature to perform said soaking function for a first predetermined period of time;

(b) at the end of the first predetermined period of time, starting a second counter and applying heat to said cooker at a second temperature higher than said first temperature to perform said cooking function for a second predetermined period of time;

(c) at the end of said second predetermined period of time, starting a third counter and applying heat to said cooker at a third temperature below said second temperature to perform said steam-settle-down function for a third predetermined period of time;

(d) comparing the temperature of said metal pan to a different reference temperature for each of steps (a), (b) and (c) and discontinuing application of electrical power to said cooker whenever the compared temperature in each of steps (b) and (c) exceeds the respective reference temperature, the power being reapplied when the compared temperature in each of steps (a), (b) and (c) is below the respective reference temperature; and (e) initiating step (c) at the end of said second predetermined period of time irrespective of the temperature of said metal pan;

whereby said cooker is sequentially operated through said soaking, cooking and steam-settle-down function steps and then placed into a keep-warm function.

2. A device for preventing overheating of an inverter cooker having a metal pan and soaking, cooking and steam-settle-down functions, said device comprising:

(a) means for starting a first counter and applying heat to said cooker at a first temperature to perform said soaking function for a first predetermined period of time;

(b) means, responsive to the end of the first predetermined period of time, for starting a second counter and applying heat to said cooker at a second temperature higher than said first temperature to perform said cooking function for a second predetermined period of time;

(c) means, responsive to the end of said second predetermined period of time, for starting a third counter and applying heat to said cooker at a third temperature below said second temperature to perform said steam-settle-down function for a third predetermined period of time; and (d) means for comparing the temperature of said metal pan to a different reference temperature during each of the first, second and third predetermined periods of time, control means for discontinuing application of electrical power to said cooker whenever the compared temperature exceeds the respective reference temperature during each of the first, second and third predetermined periods of time, said control means reapplying the electrical power to said cooker whenever the compared temperature is below the respective reference temperature during each of the first, second and third predetermined periods of time;.

at the end of the second predetermined period of time, said third counter starting means applying heat to said cooker at the third temperature irrespective of the temperature of said metal pan;

whereby said cooker is sequentially operated through soaking, cooking and steam-settle-down functions and then placed into a keep-warm function.

3. The device of claim 2 wherein said temperature comparing means comprises means responsive to a bottom sensor for comparing a voltage representative of a detected temperature to a voltage representative of a respective one of the first, second and third reference temperatures; means for generating an output counter signal during each one of the first, second and third predetermined periods of time; and an AND-gate connected at respective input terminals to said comparing means and said signal generating means for generating a heat control output signal only when said detected temperature is below a respective one of the reference temperatures and said output counter signal is being applied thereto.

* * * * *